US008082761B2

(12) United States Patent
Wang et al.

(10) Patent No.: US 8,082,761 B2
(45) Date of Patent: Dec. 27, 2011

(54) METHOD OF FORMING INTEGRATED MULTILAYER FABRICS

(75) Inventors: Youjiang Wang, Atlanta, GA (US); Qian Zhao, Nanjing (CN); Zhong-Xing Mi, Raleigh, NC (US); Jianzhong Zhang, Nanjing (CN)

(73) Assignees: Stoneferry Technology, LLC, Atlanta, GA (US); Sinoma Science & Technology Ltd., Nanjing (CN)

( * ) Notice: Subject to any disclaimer, the term of this patent is extended or adjusted under 35 U.S.C. 154(b) by 238 days.

(21) Appl. No.: 12/503,944

(22) Filed: Jul. 16, 2009

(65) Prior Publication Data

US 2011/0014403 A1 Jan. 20, 2011

(51) Int. Cl.
*D04B 39/06* (2006.01)

(52) U.S. Cl. ..... 66/1 R; 66/170

(58) Field of Classification Search ..... 66/1 R, 66/7, 90, 116, 169 R, 170; 139/383 B, 384, 139/1 R See application file for complete search history.

(56) References Cited

U.S. PATENT DOCUMENTS

| | | | | |
|---|---|---|---|---|
| 3,834,424 | A * | 9/1974 | Fukuta et al. | 139/22 |
| 4,001,478 | A | 1/1977 | King | |
| 4,066,104 | A * | 1/1978 | Halton et al. | 139/11 |
| 4,312,261 | A | 1/1982 | Florentine | |
| 4,346,741 | A | 8/1982 | Banos et al. | |
| 4,506,611 | A | 3/1985 | Parker et al. | |
| 4,518,640 | A | 5/1985 | Wilkens | |
| 4,863,660 | A * | 9/1989 | Cahuzac et al. | 264/103 |
| 5,085,252 | A | 2/1992 | Mohamed et al. | |
| 2005/0235471 | A1 | 10/2005 | Delecroix | |

OTHER PUBLICATIONS

Park et al., Analysis of filament wound composite structures considering the change of winding angles through the thickness direction, Composite Structures, Elsevier Science Ltd., 2001, pp. 63-71.

Mallick, Fiber-Reinforced Composites, Materials, Manufacturing and Design, Second Edition, Marcel Debber, Inc., New York, 1993, pp. 393-403.

* cited by examiner

*Primary Examiner* — Larry Worrell, Jr

(74) *Attorney, Agent, or Firm* — Morris Manning & Martin LLP; Tim Tingkang Xia, Esq.

(57) ABSTRACT

A method for fabricating multilayer fabrics having a prescribed integration pattern and an apparatus of implementing same. In one embodiment, the method include the steps of providing a plurality of winding yarn carriers arranged in a multilayer structure along a first direction and configured such that each winding yarn carrier is operably movable with respect to one another along a second direction that is perpendicular to the first direction, forming a plurality of crossover points of the winding yarns by moving at least one winding yarn carrier along the second direction according to the integration pattern, transporting the binder yarns through the plurality of winding yarn layers at predetermined locations along the first direction, and locking the binder yarns in place, pushing the binder yarns toward the fell of the multilayer fabrics, and taking up the formed multilayer fabrics.

12 Claims, 8 Drawing Sheets

METHOD OF FORMING INTEGRATED MULTILAYER FABRICS

CROSS-REFERENCE TO RELATED PATENT APPLICATION

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference were individually incorporated by reference.

FIELD OF THE INVENTION

This invention generally relates to multilayer fabrics, and more particularly to integrated multilayer fabrics having a prescribed integration pattern formed of winding yarns arranged in a plurality of layers at prescribed angles bound together by a set of through-the-layers binder yarns, and an apparatus and method of fabricating same.

BACKGROUND OF THE INVENTION

Integrated multilayer fabrics have wide applications such as advanced composites, power transmission and conveyer belts, fabrics in paper forming machines, among others.

Advanced composites include high performance fibers in a matrix. Depending on the fibers and matrix materials and manufacturing parameters, advanced composites offer superior strength-to-weigh and modulus-to-weight ratios, fatigue strength, damage tolerance, tailored coefficient of thermal expansion, chemical resistance, weatherability, temperature resistance, among others.

Fibers are the basic load-bearing component in a fiber reinforced composite. They are often pre-assembled into various forms to facilitate the fabrication of composite parts. Advanced composites are often made from prepreg tapes, sheets and fabrics that are parallel continuous fibers or single-layer fabrics held by a matrix forming material. They are used to make parts by laminate layup and tape or filament winding. The traditional laminated composites are vulnerable to delamination because the layers of strong fibers are connected only by the matrix material that often is much weaker than the fibers. The introduction of fiber reinforcement in the through-the-thickness direction in a three dimensional composite could effectively control delamination failures and make the composite very damage tolerant. Besides performance enhancement, composites reinforced with integrated fiber structures may also offer other advantages such as the potential for automated and net shape processing and lower manufacturing cost.

Fully interlocked and adjacent layer interlocked three dimensional fabrics may be formed by weaving or braiding. In such fabrics the yarns are crimped due to yarn interlacing or intertwining, and the yarn crimps in the fabrics cause a reduction in the stiffness and strength of the composites reinforced with such fabrics. Although the fabrics layers are integrated by interlocking, there are no reinforcing yarns placed directly in the through-the-thickness direction.

Multilayer fabrics having layers of parallel fibers at predetermined angles bound by a knitting process, known as non-crimp fabrics, are also commonly used in reinforced composites. Methods of making such multilayer fabrics are disclosed in U.S. Pat. No. 4,518,640 to Wilkens. These methods are suitable for making flat fabrics with fixed yarn orientations. The in-plane layers normally include high performance fibers such as glass and/or graphite fibers, whereas the knitting yarns generally are made of flexible fibers such as poly(ethylene terephthalate) (PET) or aramid rather than using the same type of high performance fibers as in the in-plane layers.

Fabricss with solid rectangular or other cross sectional shapes such as I and T sections may be constructed with reinforcing fibers in both in-plane and through-the-thickness directions by three dimensional weaving and braiding processes, as disclosed in, for examples, U.S. Pat. No. 4,312,261 to Florentine and U.S. Pat. No. 5,085,252 to Mohamed et al. These processes are generally limited in the dimensions of the fabrics that can be produced.

Tubular fabrics may be constructed with reinforcing fibers both in the circumferential layers and in the through-the-thickness direction, as disclosed in, for example, U.S. Pat. No. 4,001,478 to King and U.S. Pat. No. 4,346,741 to Banos et al. Such processes do not afford the flexibility of changing the fabrics geometry and yarn orientation at different locations in the fabrics as needed.

The traditional methods of forming integrated fabrics lack the flexibility of varying the fiber orientation and/or the cross sectional shape and/or dimension as the fabrics are being formed. They are often associated with other disadvantages such as low production rate, low level of automation, need for frequent replenishment of yarn packages, and low fiber volume fraction.

Therefore, a heretofore unaddressed need exists in the art to address the aforementioned deficiencies and inadequacies.

SUMMARY OF THE INVENTION

The method disclosed in this invention overcomes the above mentioned limitations and disadvantages of the existing methods for forming integrated fabrics, so that parts with simple as well as complex shapes can be made without yarn interlacing or intertwining. The method provides for the use of large yarn packages, simple tension control, the ability to be scaled up to produce fabrics with large cross sectional dimensions, and the process can be highly automated, among other advantages.

In one aspect, the present invention relates to a method for fabricating multilayer fabrics having a prescribed integration pattern with winding yarns and binder yarns. In one embodiment, the method includes the step of providing a plurality of winding yarn carriers arranged in a multilayer structure along a first direction and configured such that each winding yarn carrier is operably movable with respect to one another along a second direction that is perpendicular to the first direction. Each winding yarn carrier has a set of spatially-separated supply yarn packages adapted for supplying the winding yarns to form a winding yarn layer, whereby the supplied winding yarns from the plurality of winding yarn carriers form a plurality of winding yarn layers. In one embodiment, the plurality of winding yarn carriers arranged such that the winding yarns form a plurality of winding yarn layers at prescribed angles in ranges from about 0° to about ±90° with respect to the first direction that is coincident with the longitudinal direction of the formed multilayer fabrics.

The method further includes the step of (a) forming a plurality of crossover points of the winding yarns by moving at least one winding yarn carrier along the second direction according to the integration pattern; (b) transporting the binder yarns through the plurality of winding yarn layers at predetermined locations along the first direction, and locking the binder yarns in place; (c) pushing the binder yarns toward the fell of the multilayer fabrics; (d) taking up the formed multilayer fabrics; and (e) repeating steps (a)-(d) until the multilayer fabrics are fabricated to have desired dimensions.

The method may also include the step of removing slacks in the binder yarns before the taking up step is performed.

In one embodiment, the binder yarns are carried by a plurality of binder yarn insertion needles positioned in relation to the plurality of winding yarn carriers. The transporting step is performed by passing the plurality of binder yarn insertion needles through the plurality of winding yarn layers at the predetermined locations along the first direction, so as to fasten the plurality of winding yarn layers together through-the-layers.

In one embodiment, the prescribed integration pattern is formed by controlling the layer number of the winding yarns, relative distances of the winding yarn carrier movements, and activation or omission of the binder yarns in operation.

In another aspect, the present invention relates to an apparatus for fabricating multilayer fabrics having a prescribed integration pattern. In one embodiment, the apparatus has a plurality of winding yarn carriers arranged in a multilayer structure along a first direction and configured such that each winding yarn carrier is operably movable with respect to one another along a second direction that is perpendicular to the first direction. Each winding yarn carrier has a set of spatially-separated supply yarn packages adapted for supplying the winding yarns to form a winding yarn layer, whereby the supplied winding yarns from the plurality of winding yarn carriers form a plurality of winding yarn layers. The movements of one or more winding yarn carriers in opposite directions create a plurality of crossover points by the corresponding winding yarns. Each winding yarn carrier can be moved angularly or translationally along the second direction.

The apparatus also has a plurality of binder yarn insertion needles positioned in relation to the plurality of winding yarn carriers for transporting binder yarns through the plurality of winding yarn layers at the predetermined locations along the first direction, so as to fasten the plurality of winding yarn layers together through-the-layers, and at least one beating bar adapted for inserting through openings of the laid winding yarns for a beat-up motion at a predetermined time to push the binder yarns toward the fell of the fabrics.

In one embodiment, the apparatus further comprises a plurality of shaping rings adapted for condensing the plurality of winding yarn layers and supporting the winding yarn layers while the binder yarns are inserted and during the beat-up motion. The positions of the plurality of shaping rings are changeable during each cycle of fabrics formation.

The apparatus may also have a holding yarn feeding needle and a holding yarn insertion needle positioned in relation to the plurality of binder yarn insertion needles such that when the plurality of binder yarn insertion needles insert the binder yarns through the plurality of winding yarn layers to form open loops by folding the binder yarns, the holding yarn feeding needle and the holding yarn insertion needle move a holding yarn through the binder yarn open loops to lock the binder yarns in the fabrics.

In addition, the apparatus may further have an auxiliary bar accompanying each binder yarn insertion needle for keeping the binder yarn loop open while the holding yarn is inserted, and for tightening the binder yarn after the holding yarn is inserted while limiting the bending curvature in the binder yarn as it is tightened.

In one embodiment, the apparatus may include a knitting mechanism having a needle and a yarn feeder to form a loop of the holding yarn that goes through the open loop of the folded binder yarn, wherein the holding yarn is adapted for holding the binder yarn in place, and preventing the binder yarn from being pulled out as the binder yarn insertion needle retreats and the slacks in the binder yarn is removed.

In one embodiment, the apparatus has one or more tensioning control devices placed in each winding yarn carrier for regulating the tension of the winding yarns as the winding yarns are withdrawn, and a braking mechanism associated with the one or more tension control devices for preventing the winding yarns from being withdrawn during the beat-up motion.

In yet another aspect, the present invention relates to a method for fabricating multilayer fabrics having a prescribed integration pattern in connection with an apparatus having a plurality of winding yarn carriers arranged in a multilayer structure along a first direction and configured such that each winding yarn carrier is operably movable with respect to one another along a second direction that is perpendicular to the first direction, wherein each winding yarn carrier has a set of spatially-separated supply yarn packages adapted for supplying the winding yarns to form a winding yarn layer, whereby the supplied winding yarns from the plurality of winding yarn carriers form a plurality of winding yarn layers, and wherein the movements of one or more winding yarn carriers in opposite directions create a plurality of crossover points by the corresponding winding yarns; a plurality of binder yarn insertion needles positioned in relation to the plurality of winding yarn carriers; a holding yarn feeding needle and a holding yarn insertion needle having a hook, positioned in relation to the plurality of binder yarn insertion needles; and at least one beating bar.

In one embodiment, the method includes the steps of (a) moving at least one winding yarn carrier along the second direction according to the integration pattern to form a plurality of crossover points of the winding yarns; (b) inserting the plurality of binder yarn insertion needles through the plurality of winding yarn layers at predetermined locations along the first direction for transporting the binder yarns through the plurality of winding yarn layers to form open loops by folding the binder yarns; (c) locking the inserted binder yarns in place, so as to fasten the plurality of winding yarn layers together through-the-layers; (d) inserting at least one beating bar through openings of the laid winding yarns for a beat-up motion at a predetermined time to push the binder yarns toward the fell of the fabrics; (e) taking up the formed multilayer fabrics at a predetermined rate; and (f) repeating steps (a)-(e) until the multilayer fabrics are fabricated to have desired dimensions.

In one embodiment, the motion of locking the binder yarns in place comprises the steps of (a) inserting the holding yarn insertion needle through a binder yarn loop; (b) retreating the binder yarn insertion needle associated with the bind yarn loop from the top surface of the fabrics without tightening the binder yarn; (c) moving the holding yarn feeding needle inward to feed a holding yarn to the hook of the holding yarn insertion needle; (d) retreating the holding yarn insertion needle through the binder yarn loop and lock the holding yarn into a prior holding yarn loop; (e) tightening the binder yarn as the holding yarn insertion needle retreats further; and (f) moving the holding yarn insertion needle circumferentially to a next binder yarn loop; and (g) repeating steps (a)-(f) until all the binder yarns are locked and tightened in place.

In one embodiment, the method further includes the step of beating up the winding yarn layers before the inserting step is performed.

The present invention provides a method for forming integrated multilayer fabrics having a variety of constant or variable cross sectional shapes, constant or variable fiber orientation and integration patterns. In the integrated multilayer fabrics, there are two systems of yarns, one is the system of winding yarns and the other is system of binder yarns. The winding yarns are arranged in a plurality of layers at prescribed angles that can vary in ranges from about 0° to about ±90° with respect to longitudinal direction of the fabrics. The binder yarns are to fasten, through-the-layers, the layers of winding yarns together. An auxiliary system of holding yarns may be used to lock the binder yarns in place. Since the primary function of the holding yarns is not to provide structural strength and stiffness to the fabrics structure but to simply hold the binder yarns in place, flexible fibers such as nylon or PET threads may be used as the holding yarns. The supply yarns to form each layer of winding yarns are placed in an individual carrier. Fabrics with desired cross sectional shape, fiber orientation and integration patterns is formed by repeating a cycle of operations which includes the following steps: forming a plurality of new cross over points of the winding yarns by moving each of the winding yarn carriers according to the integration pattern; transporting a plurality of the binder yarns through the layers of the winding yarns at desired locations and locking the binder yarns in place; pushing the binder yarns to the position to form the fabrics and removing any slacks in the yarns and taking up the newly formed fabrics by a controlled distance in the direction of the machine direction, i.e., the longitudinal direction of the fabrics. The integrated multilayer fabrics having variable cross sectional shapes, variable fiber orientations, and variable integration patterns are formed by controlling the number of fiber layers engaged, the relative distances of the winding yarn carriers movement, and activation or omission of binder yarns as the forming process proceeds.

It is therefore the object of this invention to provide a method for forming integrated multilayer fabrics of a desired cross-sectional geometry consisting of multiple layers of fibers bound together by through-the-layers binder yarns, each layer following prescribed fiber orientation, and the fibers in the layers being not interlaced or intertwined.

It is another object of this invention to provide a method for forming integrated multilayer fabrics of desired cross sectional geometry. Examples of the cross sections include regular or irregular tubular shapes, and regular or irregular solid shapes such as I-section, T-Section, U-Section, and flat section, among others.

It is yet another object of this invention to provide a method for forming integrated multilayer fabrics of variable cross-sectional geometry such that the cross-sectional dimensions can vary along the lengthwise direction of the fabrics.

It is a further object of this invention to provide a method for forming integrated multilayer fabrics of variable cross-sectional geometry such that the shape can vary along the lengthwise direction of the fabrics.

It is yet a further object of this invention to provide a method for forming integrated multilayer fabrics of variable cross-sectional geometry such that the wall thickness for the fabrics in a hollow form, or the thickness of the fabrics in solid form, can vary along the lengthwise direction of the fabrics.

It is one object of this invention to provide a method for forming integrated multilayer fabrics of variable cross sectional geometry such that the wall thickness for hollow sectioned fabrics can vary within the cross-sectional and along the length of the fabrics.

It is another object of this invention to provide a method for forming integrated multilayer fabrics of variable cross sectional geometry such that the integration pattern can vary by the fixation or omission of selected binder yarns or by the method of binder yarn fixation.

It is yet another object of this invention to provide a method for forming integrated multilayer fabrics in which the fiber orientation of each layer may vary along the lengthwise direction of the fabrics.

It is a further object of this invention to provide a method for forming integrated multilayer fabrics by withdrawing yarns to form the fabrics layers from the yarn supply packages without paying back thus eliminating the need for springs or elastic bands for paying out and pulling back yarns as required in common two dimensional and three dimensional braiding processes.

It is yet a further object of this invention to provide a method for forming integrated multilayer fabrics by controlling yarn tensions with direct tension control devices facilitated by the fact the yarns forming the fabrics layers only move in one direction from the packages without the need to compensate for yarn paying back.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
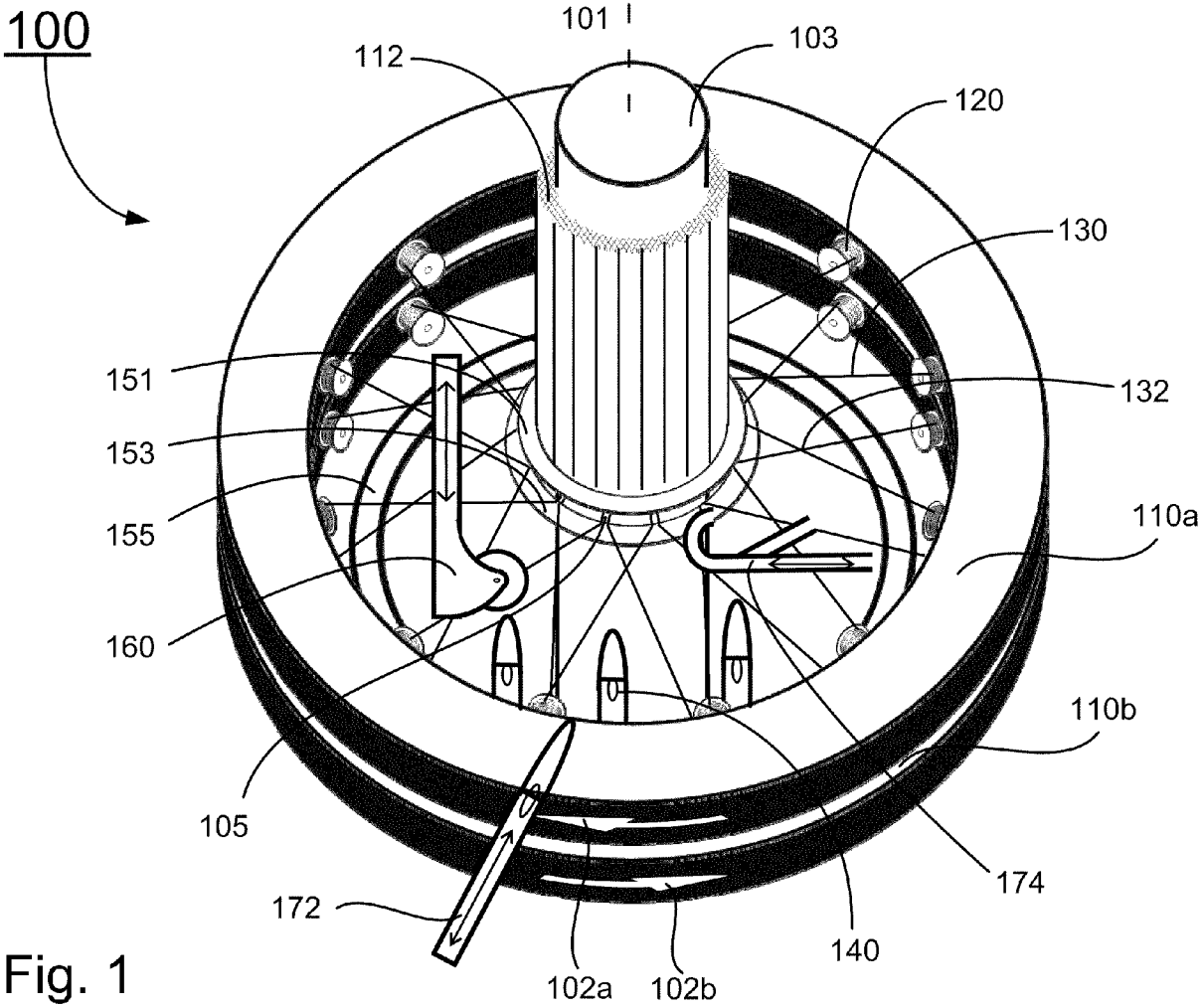
FIG. 1 shows schematically an apparatus for fabricating multilayer fabrics according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the present invention in conjunction with the accompanying drawings in FIGS. 1-8. In accordance with the purposes of this invention, as embodied and broadly described herein, this invention, in one aspect, relates to integrated multilayer fabrics formed of yarns arranged in a plurality of layers at prescribed angles bound together by a set of through-the-layers yarns, and a method of forming the integrated multilayer fabrics that can be tailored to have a variety of constant or variable cross sectional shapes, constant or variable fiber orientation and integration patterns according to requirements for local fiber architecture and fabrics geometry.

According to the present invention, integrated multilayer fabrics are fabricated with two systems of yarns: the winding yarns and the binder yarns. The winding yarns are arranged in a plurality of layers at prescribed angles that can vary in the ranges from about 0° to about ±90° with respect to longitudinal direction of the fabrics. The binder yarns are used to fasten the desired layers of the winding yarns together. The number of the layers of winding yarns can be varied as desired but limited by the number of winding yarn carriers in the apparatus. In one embodiment, the layers of winding yarns may be shaped by an optional mandrel of appropriate geometry along the machine direction to form hollow fabrics or fabrics with a core. The winding yarn orientations for the individual layers can be altered for different locations within the fabrics as the fabrics are being formed.

Referring to FIG. 1, an apparatus 100 for fabricating integrated multilayer fabrics with a prescribed integration pattern is schematically shown according to one embodiment of the present invention. The apparatus 100 has two winding yarn carriers 110*a* and 110*b* arranged in a two-layer structure along a first direction 101 and configured such that each winding yarn carrier 110*a*/110*b* is operably movable with respect to one another along a second direction 102*a*/102*b* that is perpendicular to the first direction 101. The winding yarns 130 are provided by a plurality of yarn supply packages 120. The yarn supply packages 120 supplying the winding yarns 130 to form each layer of the fabrics are spaced mounted on one individual yarn carrier 10*a*/110*b*. In this exemplary embodiment shown in FIG. 1, a mandrel 103 is employed to take up the fabricated fabrics 112, and the ends of the winding yarns 130 extending from the supply yarn packages 120 are incorporated into the fabrics laid on the mandrel 103. The movements of one or more winding yarn carriers 110*a* and 110*b* in opposite directions 102*a* and 102*b* create a plurality of crossover points 132 by the corresponding winding yarns 130.

In this embodiment, the winding yarn carriers 110*a* and 110*b* are configured to be angularly rotatable either individually or cooperatively, along the directions 102*a* and/or 102*b*. The rotations of the winding yarn carriers 110*a* and 110*b* are around the axis 101 of the mandrel 103. Accordingly, tubular or tubular-like multilayer fabrics can be fabricated. In other embodiments, the winding yarn carriers may be configured to be translationally movable either individually or cooperatively along a (second) direction that is perpendicular to a (first) direction along which the winding yarn carriers are aligned/arranged. In operation, the movements of the winding yarn carriers are controlled by the control system. The prescribed integration pattern is formed by controlling the layer number of the winding yarns, relative distances of the winding yarn carrier movements, the distance of fabric take up in the first direction, and activation or omission of the binder yarns in operation.

Additionally, two winding yarn carriers 110*a* and 110*b* are utilized in the exemplary embodiment, and thus the supplied winding yarns 130 from the two winding yarn carriers 110*a* and 110*b* form a two winding yarn layers. However, there is no limitation on the number of the winding yarn carriers to be used to practice the present invention. According to the present invention, the number of the winding yarn carriers determines the maximum number of layers of the fabrics to be produced.

Each carrier of the winding yarns places the yarns in a ply at a desired angle by a motion in the circumferential direction such as the rotation of a rigid ring carrier. The winding yarn carriers may be rigid or flexible. Rigid carriers may be circular as described in the example or having other geometric shapes. Examples of flexible carriers include belts, chains, and linked mechanisms moving on tracks.

In one embodiment, winding yarns from some of the winding yarn carriers can be supplied from a stationary creel. These carriers may remain stationary during the process to place 0° layers of winding yarns, or may move in a back and forth motion to form ribs in the fabric.

Packages to supply the winding yarns may contain one yarn per package, or multiple yarns in a single package to supply multiple threads during the winding motion. The packages may be of flanged, cross wound, or other configurations. The winding yarn packages may be placed on the inside face, on the outside face, a side face, or inside the carrier.

Additionally, one or more tension control devices (not shown) may be fitted on each winding yarn carrier to regulate the tension of the winding yarns as they are withdrawn. A braking mechanism may be employed as a separate or as a part of the tension control device to prevent the winding yarns from being withdrawn during beat-up.

The apparatus 100 also has one or more binder yarn insertion needles 140 positioned in relation to the plurality of winding yarn carriers 130 for transporting/inserting binder yarns through the plurality of winding yarn layers at the predetermined locations along the first direction 101, so as to fasten the plurality of winding yarn layers together through-the-layers.

The binder yarns are provided by appropriate packages that can be individual packages or multi-thread packages such as beams. The binder yarns are inserted through the layers of winding yarns 130 at appropriate internals specified by the integration pattern and are locked in place. The binder yarns may be introduced in the through-the-layers direction after the newly laid winding yarns 130 are condensed together, much like in sewing. The sewing-type of layer integration may result in some impalement of the winding yarns. Additionally, the binder yarns can be inserted through the gaps between the newly formed crossover points 132 of the winding yarns 130 before they are condensed together to avoid impalement of the winding yarns, as in the case of the illustrative example presented earlier. There are several options for the mechanisms of binder yarn placement, including a variety of knitting mechanisms, rapier yarn transfer mechanisms, shuttles, sewing stations, among others.

In embodiments shown in FIGS. 1 and 3-6, a plurality of binder yarn insertion needles 140 is utilized to insert the binder yarns through the layers of winding yarns to form open loops by the folded binder yarns. The apparatus 100 may also have a holding yarn feeding needle 172 and a holding yarn insertion needle 174 positioned in relation to the plurality of binder yarn insertion needles 140. When the plurality of binder yarn insertion needles 140 inserts the binder yarns through the plurality of winding yarn layers to form open loops by folding the binder yarns, the holding yarn feeding needle 172 and the holding yarn insertion needle 174 move a holding yarn through the binder yarn open loops to lock the binder yarns in the fabrics.

Preferably, the apparatus 100 is equipped with the same number of needle sets for the binder yarn and the holding yarn as the number of winding yarn packages for fast operating speed. The motion of each needle set follows the command by the control system. As a minimum, only one holding yarn needle pair is needed. In such a case the needle pair completes one turn of movement in the circumferential direction relative to the laid winding yarn layers in each fabrics forming cycle.

As shown in FIG. 1, the apparatus 100 also has one or more beating bars 160 adapted for inserting through openings of the laid winding yarns for a beat-up motion at a predetermined time to push the binder yarns toward the fell 105 of the fabrics.

In operation, the one or more beating bars 160 penetrates through openings of the laid winding yarns 130 for the beat-up motion at appropriate time to push the winding yarns 130 toward the fabrics fell 105 in preparation for binder yarn insertion. The beat-up motion prior to binder yarn insertion allows the binder yarns to be placed as close to the fabrics fell 105 as possible. The beating bar may be fitted with rotating wheels or low friction materials, together with appropriate geometry, to minimize abrasion and damage to the winding yarns. Alternatively or in addition to the pre-insertion beat-up, a post-insertion beat-up motion may follow the binder yarn insertion to push the newly inserted binder yarn to the fabrics fell 105. Similar motion may be accomplished with a single beating bar traveling in the circumferential direction, although multiple bars are preferred for operation effectiveness and efficiency.

The apparatus 100 further comprises a plurality of shaping rings 151, 153 and 155 adapted for condensing the plurality of winding yarn layers and supporting the winding yarn layers while the binder yarns are inserted and during the beat-up motion. The positions of the plurality of shaping rings are changeable during each cycle of fabrics formation.

In addition, the apparatus 100 may further have an auxiliary bar (not shown) accompanying each binder yarn insertion needle 140 for keeping the binder yarn loop open while the holding yarn is inserted, and for tightening the binder yarn after the holding yarn is inserted while limiting the bending curvature in the binder yarn as it is tightened.

The apparatus may include a knitting mechanism having a needle and a yarn feeder to form a loop of the holding yarn that goes through the open loop of the folded binder yarn, wherein the holding yarn is adapted for holding the binder yarn in place, and preventing the binder yarn from being pulled out as the binder yarn insertion needle retreats and the slacks in the binder yarn is removed.

According to the present invention, integrated multilayer fabrics can be produced in connection with the apparatus as disclosed above, according to the following steps: at first, a plurality of crossover points of the winding yarns is formed by moving at least one winding yarn carrier along the second direction. The movements are controlled by a control system according to the integration pattern. Then, the binder yarns are transported or inserted through the plurality of winding yarn layers at predetermined locations along the first direction and are locked in place. The binder yarns are pushed toward the plurality of crossover points of the winding yarns to form multilayer fabrics. The formed multilayer fabrics are then taken up. The above steps are repeated until the multilayer fabrics are fabricated to have desired dimensions.

The process can be operated in a continuous or stepwise motion with the synchronization of the motions of the winding yarn carriers, binder yarn insertion, beat-up and take-up of the fabrics.

Figure 2:
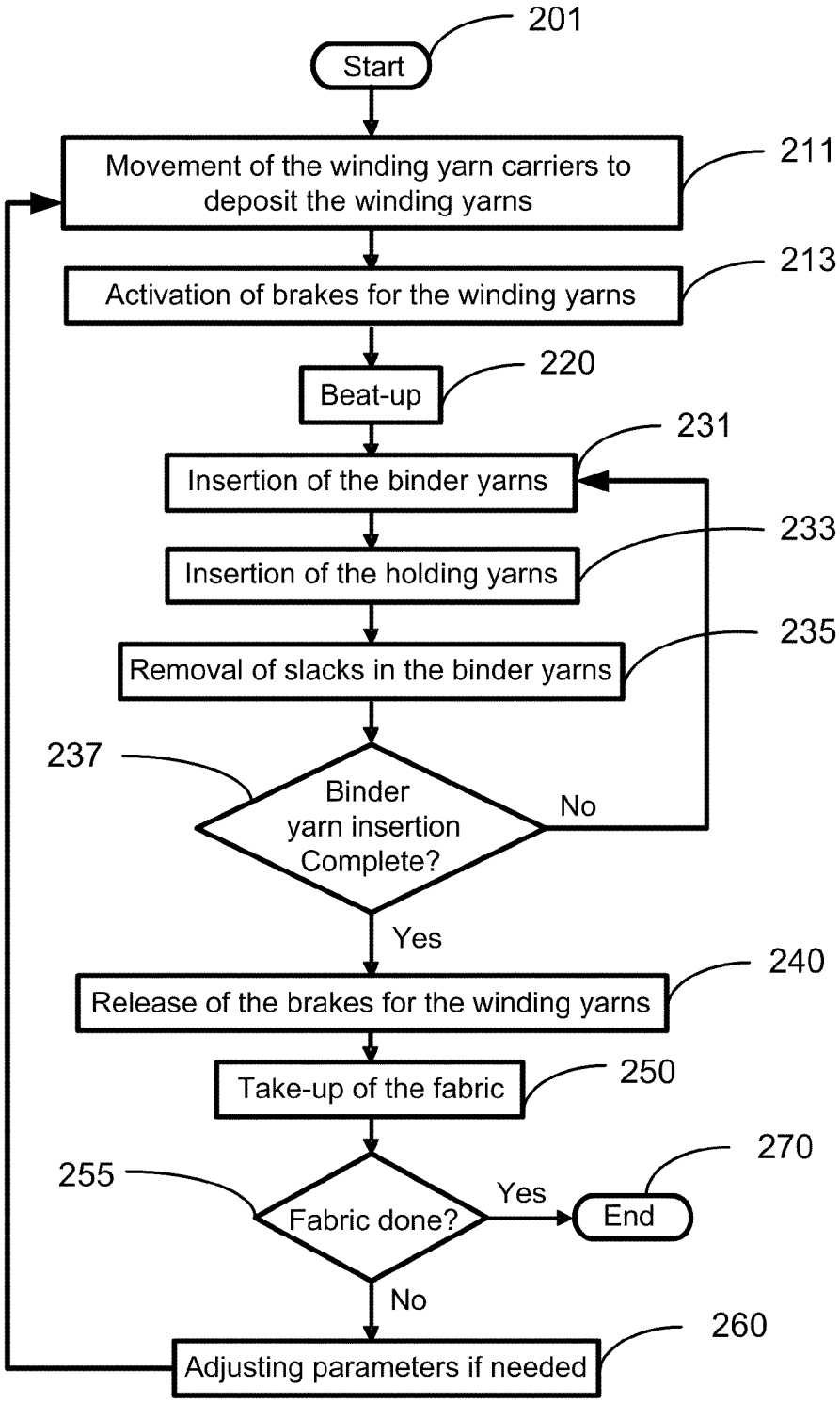
FIG. 2 shows a flow chart of a method for fabricating multilayer fabrics according to one embodiment of the present invention.
Figure 3:
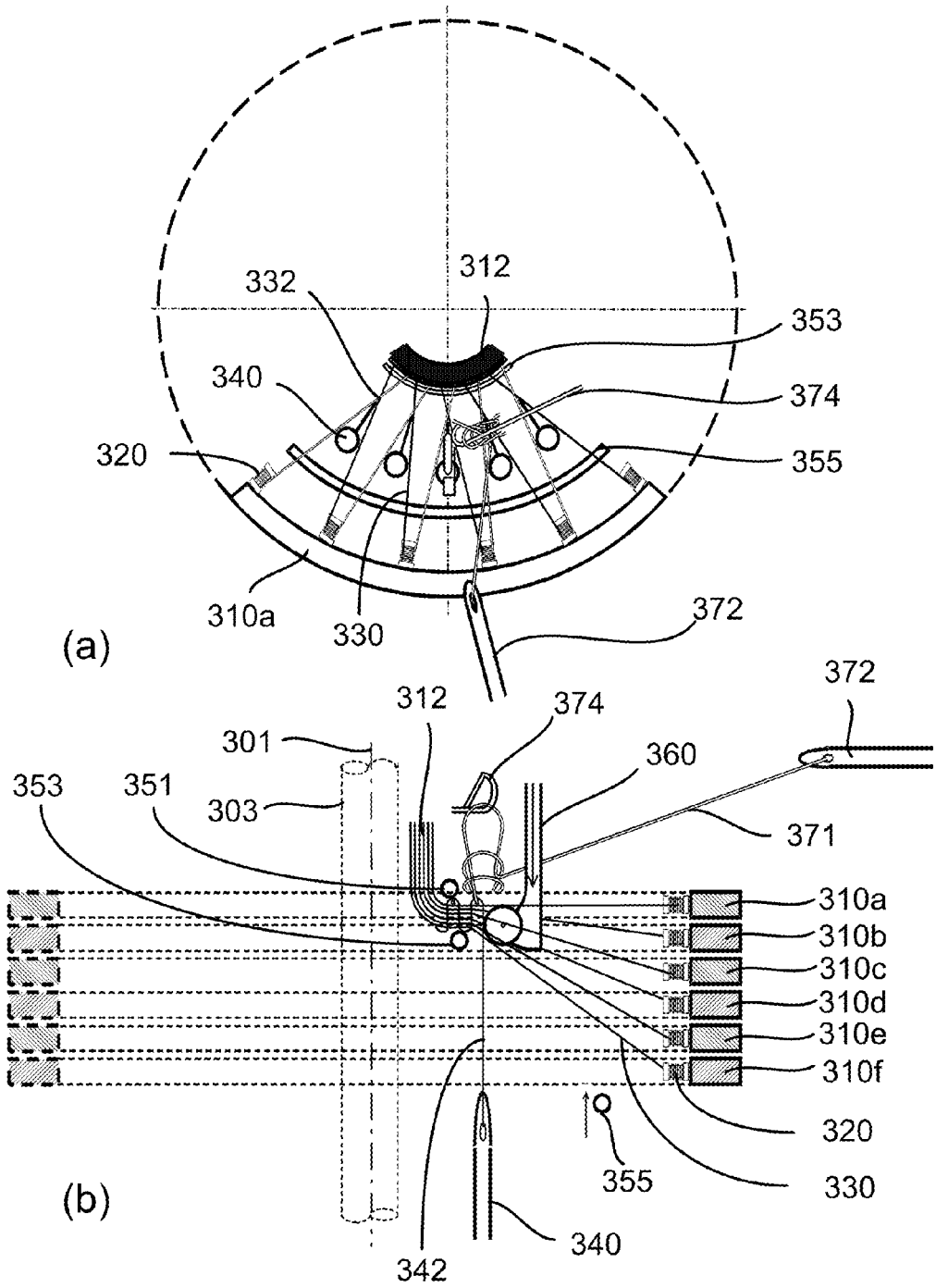
FIGS. 3-6 show schematically a sequential process for fabricating multilayer fabrics in connection with an apparatus according to one embodiment of the present invention, (a) a top view of the apparatus, and (b) a cross-sectional view of the apparatus.

Referring to FIGS. 2 and 3, and particularly to FIG. 2, a flow chart for fabricating multilayer fabrics are shown according to one embodiment of the present invention. In this embodiment, six ring-like winding yarn carriers 310*a*-310*f* are employed.

Before starting the process, each winding yarn ring carrier 310*a*, 310*b*, 310*c*, 310*d*, 310*e* or 310*f* is furnished with winding yarn packages 320 and the yarn ends are tied to the mandrel 303 placed inside the shaping ring 351 along the mandrel axis 301 whose diameter matched the inner diameter of the tubular fabrics 312 to be produced. After an initial run to reach steady-state at step 201, the following steps complete one cycle: at step 211, winding yarn carriers 310*a*-310*f* are moved, according to the designed/prescribed fabrics pattern, to deposit the winding yarns 330. In one embodiment, winding yarn carriers 310*a* (top) and 310*f* (bottom) move in the positive (counterclockwise) direction for one step, winding yarn carriers 310*b* and 310*e* in the negative (clockwise) direction for one step, winding yarn carrier 310*c* remains stationary, and winding yarn carrier 310*d* completes one revolution. Then, the brakes for the winding yarns 330 are activated for stopping depositing the winding yarns 330 at step 213. At step 220, the beating bar 360 moves to the fabrics fell for beat-up and then retreats. At step 231, the binder yarn 342 is inserted through the openings between the winding yarn crossover points 332. The binder yarn 342 is inserted and locked in place by a holding yarn 371 at step 233. At step 235, any slacks in the binder yarn and holding yarn is removed. The control system (not shown) determines whether the binder yarn insertion is complete at step 237. If the binder yarn insertion is not complete, the process will start at step 231. Otherwise, the brakes for the winding yarns 330 are released at step 240. Then, the fabricated fabric 312 is taken up by the mandrel 303 in a pre-set distance or rate at step 250. The control system determines whether the desired fabrics are done at step 255. If the desired fabrics are done, the fabricating process ends at step 270. Otherwise, the parameters may be adjusted if needed at step 260, then, the process is repeated from step 211.

The processing sequence may be adjusted and the motions may be continuous or stepwise. The combination of the speeds of the winding yarn carriers (step size of carrier motion) and the speed of fabrics take-up in the machine direction (step size of mandrel movement) determines the local yarn orientations in the fabrics. By varying the speed of the yarn carriers relative to that of fabrics take-up, the yarn orientations can be altered as required. Therefore it is possible to produce fabrics with varying ply angles along the length by adjusting the relative speeds of winding and take up as the fabrics are formed. To wind the layer at close to 90°, the number of active yarns drawn from packages should be limited or thinner yarns should be used accordingly for desired layer thickness.

FIGS. 3-6 show schematically one example of the binder yarn insertion and the corresponding locking mechanism according to one embodiment of the present invention. Auxiliary parts and some movements of the parts are omitted herewith as they are known to people skilled in the art. A plurality of binder yarn insertion needles 340 insert the binder yarns 342 through the layers of winding yarns 330 to form open loops defined by the folded binder yarns such that a holding yarn 371 may go through the loops to lock the binder yarns 342. An auxiliary bar (not shown) may accompany each binder yarn insertion needle 340 to keep the binder yarn loop open while the holding yarn 371 is inserted, and to help tightening the binder yarn 342 after the holding yarn 371 is inserted while limiting the bending curvature in the binder yarn 342 as it is tightened. A knitting mechanism including a needle and yarn feeder forms a loop of the holding yarn which goes through the open loop of the folded binder yarn. The purpose of the holding yarn 371 is to hold the binder yarn 342 in place in the fabrics 312, and to prevent the binder yarn 342 from being pulled out as the binder yarn insertion needle 340 retreats and the slacks in the binder yarn 342 is removed.

The sequence of forming holding yarn loops to lock the binder yarn is as follows, with steps (a) to (d) illustrated in FIGS. 3-6, respectively:

At step (a), as shown in FIG. 3, the outer shaping ring 355 is lowered to reduce friction among the winding yarns 330 as a given amount of winding yarns 330 are released by the angular motion of the winding yarn carriers 310*a*-310*f*. The beating bar 360 is pushed into the winding yarn layers for beat-up prior to binder yarn insertion, and then the outer shaping ring 355 is raised to condense the winding yarn layers. The beating bar 360 is then retreated.

Figure 4:
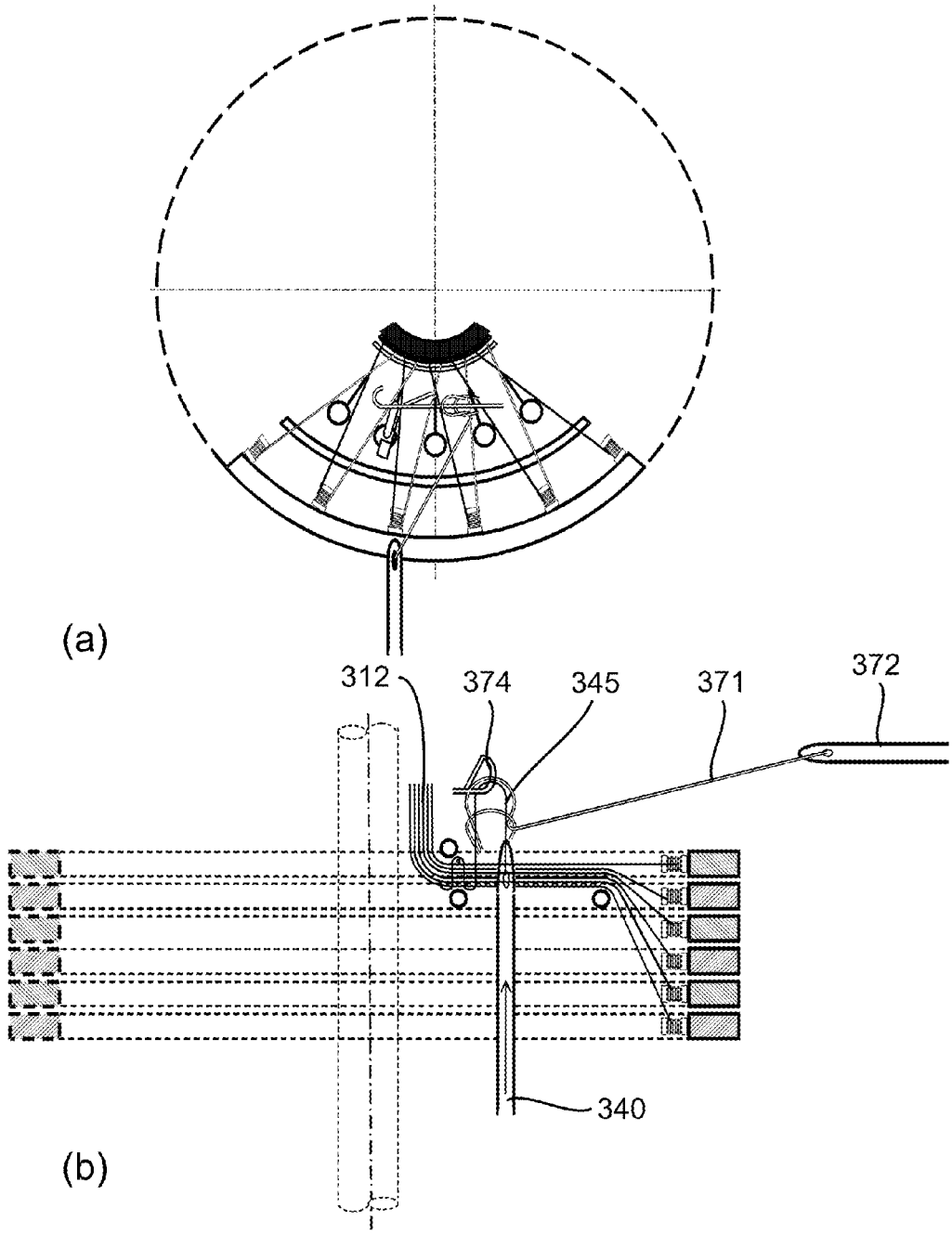

At step (b), as shown in FIG. 4, the binder yarn insertion needles 340 penetrate through the openings in the winding yarn layers to expose holding open loops 345 on the top surface of the fabrics 312. The holding yarn insertion needle 374 penetrates through the binder yarn loop 345.

Figure 5:
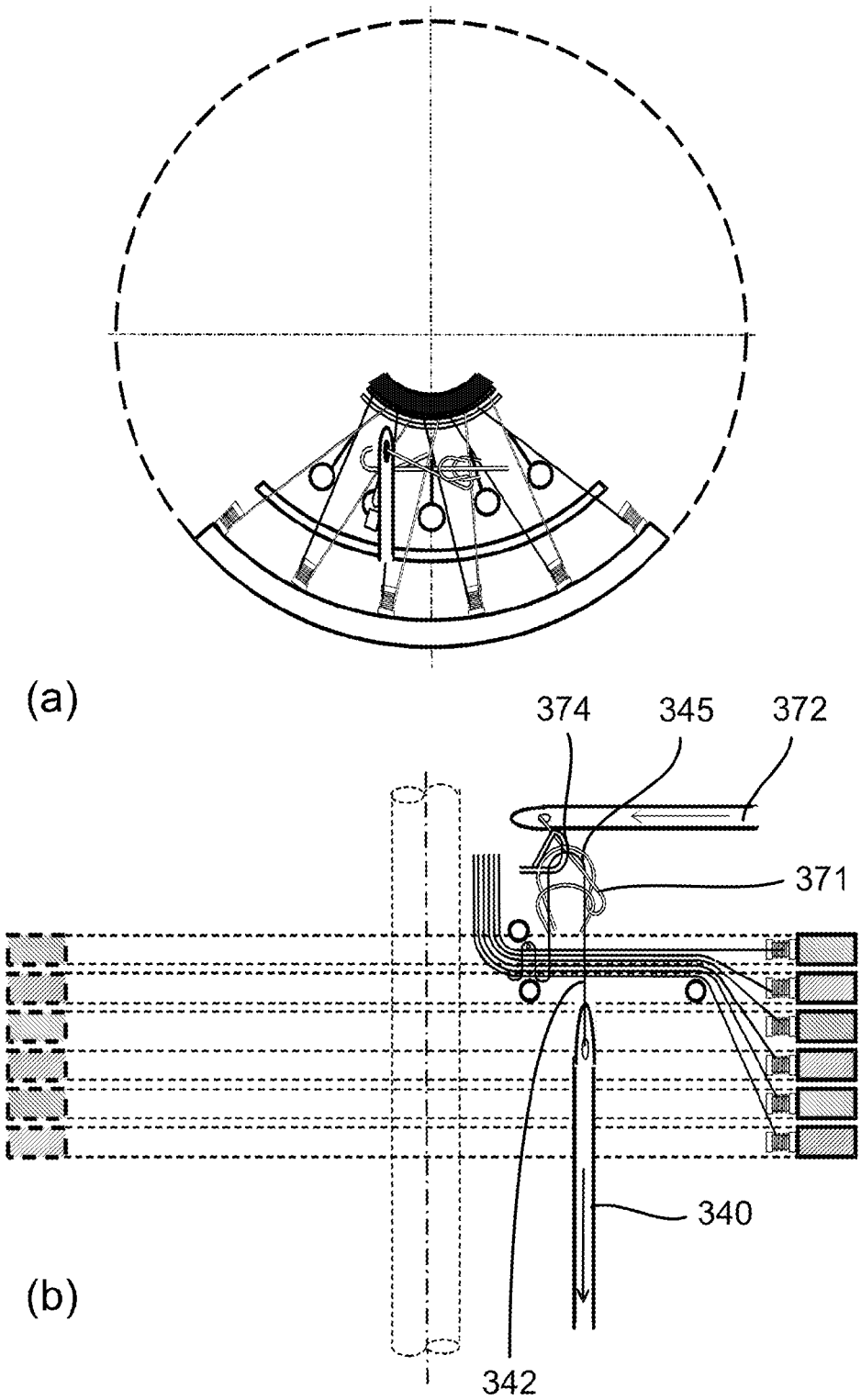

At step (c), as shown in FIG. 5, the binder yarn insertion needles 340 retreat from the top surface of the fabrics 312 without tightening the binder yarn 341. The holding yarn feeding needle 372 moves inward so as to feed the holding yarn 371 to the hook of the holding yarn insertion needle 374.

Figure 6:
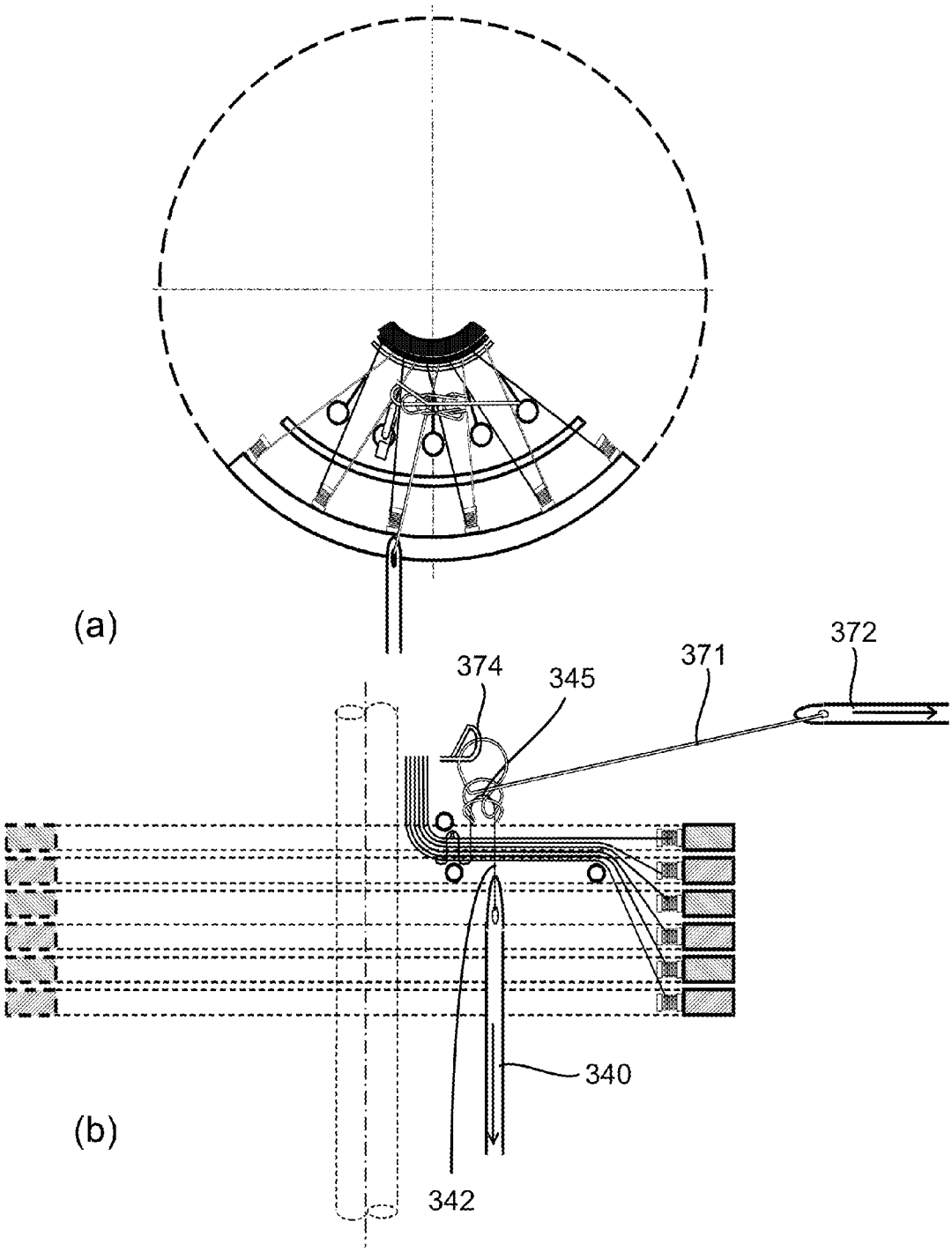

At step (d), as shown in FIG. 6, the holding yarn insertion needle 374 retreats through the binder yarn loop 345 and lock the holding yarn 371 into the previous holding yarn loop. The binder yarn 341 is tightened as the binder yarn insertion needle 340 retreats further.

The holding yarn insertion mechanism moves circumferentially to the next binder yarn location, and steps (c) and (d) are repeated until all the binder yarns 341 are locked and tightened. The mandrel carrying the fabrics advances upward for fabrics take-up.

The above steps are repeated until the entire piece of fabrics is completed.

In this illustrative example, the mandrel carrying the finished fabrics moves upwards such that the holding yarn (or binder yarn if holding yarn is not used) loops will be on the outer surface of the fabrics. Alternatively, the mandrel and the fabrics can move through the shaping ring downwards such that the loops formed by the holding yarn (or binder yarn if holding yarn is not used) appear on the inner surface of the fabrics.

According to the present invention, the insertion and locking of each binder yarn by the holding yarn at any given point can be executed or omitted via the control system, and therefore the integration pattern can be altered as desired even within the same piece of fabrics.

Figure 7:
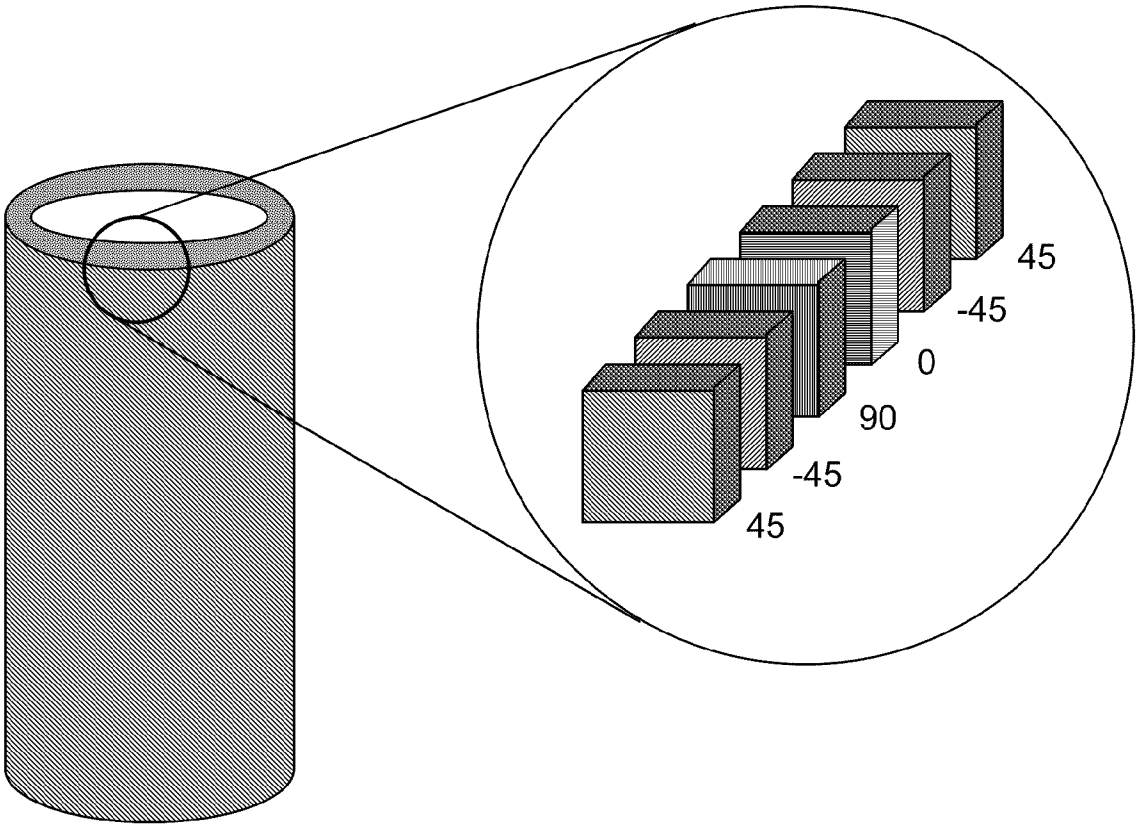
FIG. 7 shows schematically tubular fabrics with a [45/−45/0/90/−45/45] layup according to one embodiment of the present invention, where the ply orientations from inner surface to outer surface are given in degrees.

The movements of one or more winding yarn carriers in opposite directions create a plurality of crossover points by the corresponding winding yarns, which influences the pattern of the fabrics. FIG. 7 shows an example of tubular fabrics with a [45/−45/0/90/−45/45] layup, according to one embodiment of the present invention, where the ply orientations from inner surface to outer surface are given in degrees.

Figure 8:
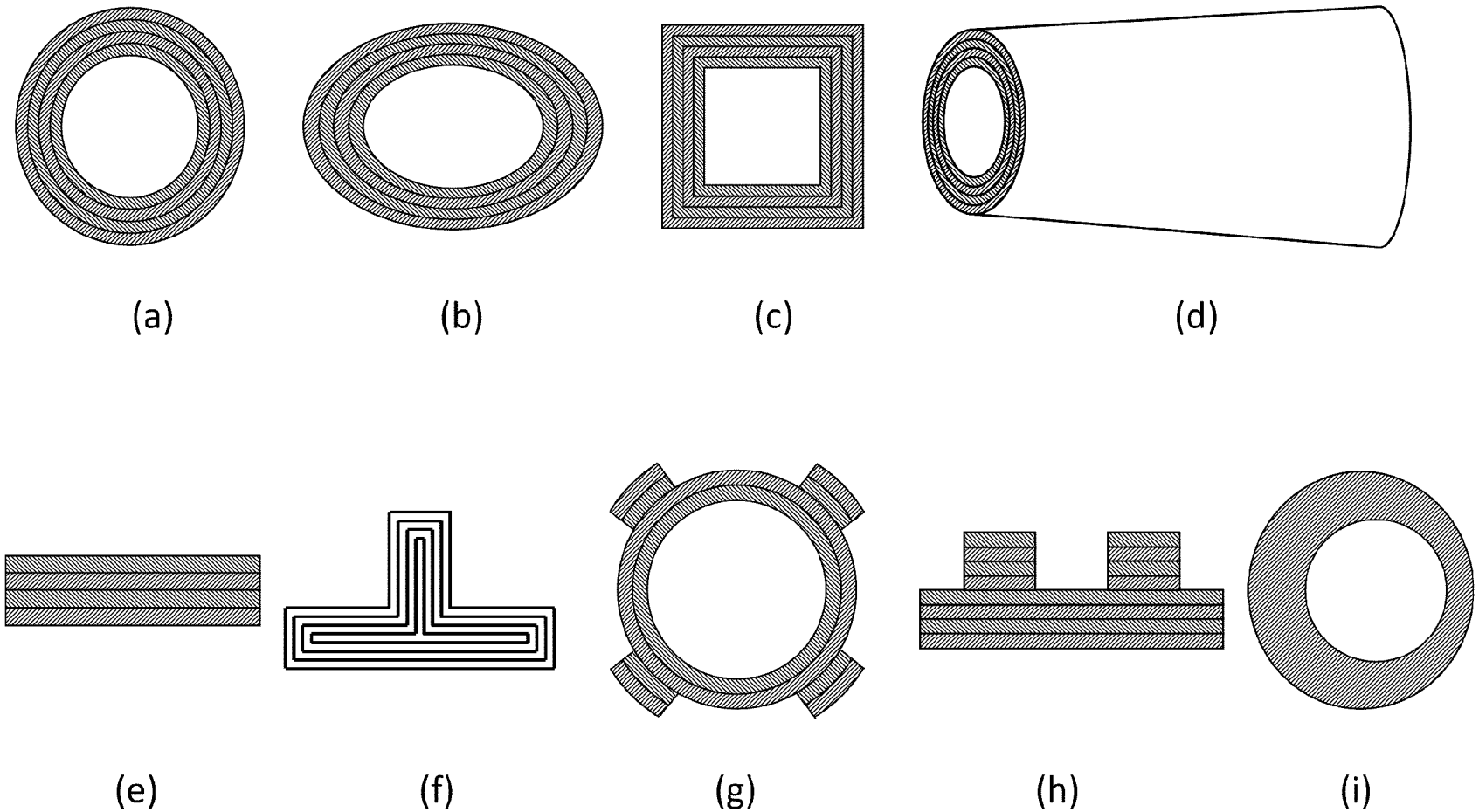
FIG. 8 shows schematically the fabrics of various cross-sectional shapes (a)-(i) fabricated according to embodiments of the present invention.

Fabrics of various cross sectional shapes may be formed according to the above disclosed method. Some of them are illustrated in FIG. 8 as examples. Besides capable of making cylindrical tubular structures (a), many variants are available to produce fabrics with different cross sectional shapes and varying cross sectional shapes along the length. The mandrel can be noncircular in shape to produce fabrics having noncircular cross sections such as those depicted in (b) and (c). The size or shape of the cross-sectional of the fabrics can also vary along the length, such as (d). In another variant, a mandrel is not use but a shaping mechanism is used instead so as flat (e) or other shaped sections (f) can be produced. A flat sectioned panel can also be made by cutting open a tubular fabric (a), and a T-section (f) can be formed by collapsing tubular fabric (a). Normally the winding yarns from each carrier form a continuous layer of yarns in the fabrics when the carrier moves in one generally direction. However, by strategically placing yarn packages at appropriate locations in the carrier and having the carrier move alternatively in a back and forth motion, a discontinuous layer may be laid. A single or a plurality of such discontinuous layers manifests themselves as ribs of the fabrics (g). The width, height, and interval of the ribs may be varied as required. The ribs may be on the outer, inner or both faces of the fabrics. Flat sectioned fabrics with ribs may be obtained by cutting open a tubular ribbed fabric (g). Fabrics with varying wall thickness within a cross-sectional (i) can be made by changing the amount of axial (0 degree) yarns at different cross sectional locations, by placing incomplete layers of winding yarns, or both.

In sum, the present invention, among other things, recites an apparatus and method for fabricating integrated multilayer fabrics with the winding yarns arranged in a plurality of layers at prescribed angles bound together by a set of through-the-layers yarns. The integrated multilayer fabrics can be tailored to have a variety of constant or variable cross sectional shapes, constant or variable fiber orientation and integration patterns according to requirements for local fiber architecture and fabrics geometry.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method for fabricating multilayer fabrics having a prescribed integration pattern with winding yarns and binder yarns, comprising the steps of:

(a) providing a plurality of winding yarn carriers arranged in a multilayer structure along a first direction and configured such that each winding yarn carrier is operably movable with respect to one another along a second direction that is perpendicular to the first direction, wherein each winding yarn carrier has a set of supply yarn packages adapted for supplying the winding yarns to form a winding yarn layer, whereby the supplied winding yarns from the plurality of winding yarn carriers form a plurality of winding yarn layers;

(b) forming a plurality of crossover points of the winding yarns by moving at least one winding yarn carrier along the second direction according to the integration pattern;

(c) transporting the binder yarns through the plurality of winding yarn layers at predetermined locations along the first direction, and locking the binder yarns in place;

(d) pushing the binder yarns toward the fell of the multilayer fabrics;

(e) taking up the formed multilayer fabrics; and (f) repeating steps (b)-(e) until the multilayer fabrics are fabricated to have desired dimensions.

2. The method of claim 1, wherein the plurality of winding yarn carriers arranged such that the winding yarns form a plurality of winding yarn layers at prescribed angles in the ranges from about 0° to about ±90° with respect to the first direction that is coincident with the longitudinal direction of the formed multilayer fabrics.

3. The method of claim 2, wherein the binder yarns are carried by a plurality of binder yarn insertion needles positioned in relation to the plurality of winding yarn carriers, and wherein the transporting step is performed by passing the plurality of binder yarn insertion needles through the plurality of winding yarn layers at the predetermined locations along the first direction, so as to fasten the plurality of winding yarn layers together through-the-layers.

4. The method of claim 1, further comprising the step of removing slacks in the binder yarns before the taking up step is performed.

5. The method of claim 1, wherein the prescribed integration pattern is formed by controlling the layer number of the winding yarns, relative distances of the winding yarn carrier movements, removed distance of fabric take up, and activation or omission of the binder yarns in operation.

6. A fabric structure fabricated according to the method of claim 1, wherein the fabric structure has a cross-sectional geometry of a hollow circular, a hollow oval, a hollow square, a hollow rectangle, a T-like shape, or the like, and wherein the fabric structure has a thickness that is uniform or variable.

7. A method for fabricating multilayer fabrics having a prescribed integration pattern in connection with an apparatus comprising:

(i) a plurality of winding yarn carriers arranged in a multilayer structure along a first direction and configured such that each winding yarn carrier is operably movable with respect to one another along a second direction that is perpendicular to the first direction, wherein each winding yarn carrier has a set of supply yarn packages adapted for supplying the winding yarns to form a winding yarn layer, whereby the supplied winding yarns from the plurality of winding yarn carriers form a plurality of winding yarn layers, and wherein the movements of one or more winding yarn carriers in opposite directions create a plurality of crossover points by the corresponding winding yarns;

(ii) a plurality of binder yarn insertion needles positioned in relation to the plurality of winding yarn carriers; and (iii) at least one beating bar, wherein the method comprises the steps of:

(a) moving at least one winding yarn carrier along the second direction according to the integration pattern to form a plurality of crossover points of the winding yarns;

(b) inserting the plurality of binder yarn insertion needles through the plurality of winding yarn layers at predetermined locations along the first direction for transporting the binder yarns through the plurality of winding yarn layers to form open loops by folding the binder yarns;

(c) locking the inserted binder yarns in place, so as to fasten the plurality of winding yarn layers together through-the-layers;

(d) inserting the at least one beating bar through openings of the laid winding yarns for a beat-up motion at a predetermined time to push the binder yarns toward the fell of the fabrics;

(e) taking up the formed multilayer fabrics at a predetermined rate; and (f) repeating steps (a)-(e) until the multilayer fabrics are fabricated to have desired dimensions.

8. The method of claim 7, wherein the apparatus further comprises a holding yarn feeding needle and a holding yarn insertion needle having a hook, positioned in relation to the plurality of binder yarn insertion needles.

9. The method of claim 8, wherein the step of locking the binder yarns in place comprises the steps of:

(a) inserting the holding yarn insertion needle through a binder yarn loop;

(b) retreating the binder yarn insertion needle associated with the bind yarn loop from the top surface of the fabrics without tightening the binder yarn;

(c) moving the holding yarn feeding needle inward to feed a holding yarn to the hook of the holding yarn insertion needle;

(d) retreating the holding yarn insertion needle through the binder yarn loop and lock the holding yarn into a prior holding yarn loop;

(e) tightening the binder yarn as the holding yarn insertion needle retreats further; and (f) moving the holding yarn insertion needle circumferentially to a next binder yarn loop; and (g) repeating steps (a)-(f) until all the binder yarns are locked and tightened in place.

10. The method of claim 7, wherein the predetermined locations through which the binder yarns are inserted are corresponding openings defined between the newly formed crossover points of the winding yarns.

11. The method of claim 7, further comprising the step of beating up the winding yarn layers before the inserting step is performed.

12. The method of claim 7, wherein each winding yarn carrier is angularly or translationally movable along the second direction.

* * * * *